United States Patent [19]

Olney

[11] Patent Number: 4,687,405

[45] Date of Patent: Aug. 18, 1987

[54] TRASH CAN DUMPING APPARATUS

[76] Inventor: David I. Olney, P.O. Box 6599, Concord, Calif. 94524

[21] Appl. No.: 748,262

[22] Filed: Jun. 24, 1985

[51] Int. Cl.[4] ..... B65F 3/04

[52] U.S. Cl. ..... 414/408; 414/421; 220/1 T

[58] Field of Search ..... 414/546, 553, 403, 404, 414/405, 406, 407, 408, 409, 410, 415, 419, 420, 421, 422, 423, 424, 425; 294/68.26, 68.27; 220/1 T

[56] References Cited

U.S. PATENT DOCUMENTS

| | | | |
|---|---|---|---|
| 3,032,216 | 5/1962 | McCarthy . | |
| 3,702,662 | 11/1972 | Davieau . | |
| 3,738,516 | 6/1973 | Wells . | |
| 3,747,785 | 7/1973 | Dahlin | 414/421 X |
| 3,804,277 | 4/1974 | Brown et al. . | |
| 3,894,642 | 7/1975 | Shive . | |
| 3,931,901 | 1/1976 | Jones . | |
| 4,042,137 | 8/1977 | Hughes et al. . | |
| 4,239,437 | 12/1980 | Naab . | |
| 4,305,693 | 12/1981 | Naab . | |
| 4,365,922 | 12/1982 | Borders . | |
| 4,422,814 | 12/1983 | Borders . | |

FOREIGN PATENT DOCUMENTS

| | | | |
|---|---|---|---|
| 129392 | 12/1984 | European Pat. Off. | 414/420 |
| 2847259 | 5/1980 | Fed. Rep. of Germany | 414/420 |
| 3024081 | 1/1981 | Fed. Rep. of Germany | 414/408 |
| 2479783 | 10/1981 | France | 414/425 |
| 2109335 | 6/1983 | United Kingdom | 414/408 |

*Primary Examiner*—Frank E. Werner

*Attorney, Agent, or Firm*—Townsend and Townsend

[57] ABSTRACT

Trash can dumping apparatus includes a pair of side-by-side clamping and lifting assemblies pivotally mounted adjacent the refuse sink of a garbage truck. A clamping member is movably mounted to the frame of each clamping and lifting assembly for capturing the lip of a trash receptacle between the clamping member and a clamping surface on the frame. To engage trash containers, which have upper and lower lifting bars, lower hooks are mounted to the frame while upper hooks are mounted to the movable clamping member. The hooks are either removed or retracted when not used. Cradle assemblies are mounted to the pivotal frame adjacent the sides of the truck. The laterally extending studs of a trash bin are captured within the slots in the cradle assemblies. To lift the trash bin, both clamping and lifting assemblies are actuated in unison. Because of the low profile nature of the dumping apparatus, workers can get next to the refuse sink opening to manually dump trash.

2 Claims, 10 Drawing Figures

TRASH CAN DUMPING APPARATUS

BACKGROUND OF THE INVENTION

This invention is related to apparatus for automatically dumping various types of trash cans, including trash bins, trash containers, and trash receptacles into a trash sink while permitting unhindered access for the worker during manual operation.

Various methods are currently being used to pick up trash for small businesses and individuals. In one method the worker empties individual trash cans into a larger trash can which is often carried using a U-shaped metal loop hooked over one shoulder. The large trash can is then manually dumped into the trash sink of the garbage truck. For increased efficiency, various types of wheeled trash cans have been developed. One type of trash can, termed trash container in this application, has a pair of generally horizontal bars along one side for grasping by mechanical dumping apparatus. See, for example, U.S. Pat. No. 4,422,817 to Borders. Another type of trash can, termed trash receptacle in this application, has an upper, generally outwardly and downwardly extending lip along one edge. At least one trash can dumping apparatus has been developed to secure these trash receptacles to the dumping apparatus by clamping the lip between a movable bar and an immovable bar and then tilting the structure upwardly. See U.S. Pat. No. 4,305,693 to Naab. The Naab patent shows a parallelogram type of arrangement for clamping the receptacle lip and tilting the trash receptacle. It, however, is not particularly well suited for use when trash cans are to be dumped manually into the trash sink because the distance the parallelogram dumping apparatus extends from the back of the truck keeps workers from getting close to the edge of the trash sink.

The third type of trash can, termed a trash bin in this application, often used at small businesses, is made in the form of a rectangular box. It has two laterally extending studs on opposite sides of the bin near the ends of the front, upper edge. The bin is sized so that it is about the same length as the opening to the trash sink on the garbage truck. After securing the bin to the truck by engaging the laterally extending studs, the prior art dumping apparatus then automatically lifts and tilts the trash bin to dump the trash into the trash sink of the garbage truck. See U.S. Pat. No. 3,931,901 to Jones.

SUMMARY OF THE INVENTION

The present invention solves one of the problems of the prior art by accommodating at least three types of automatically dumpable trash cans and still permits close physical access to the trash sink of a garbage truck by the worker to permit manual dumping of the trash cans.

The invention is directed to a trash can dumping apparatus that includes a pair of side-by-side clamping and lifting assemblies pivotally mounted adjacent the trash sink of a garbage truck. Each clamping and lifting assembly includes a frame secured to a horizontally positioned support shaft, each support shaft being pivotal about a common axis through an associated hydraulic lift cylinder and crank arm.

A trash receptacle clamping member is mounted to the frame for movement towards and away from a receptacle lip clamping bar, secured to the frame adjacent the support shaft, for capturing the lip of a trash receptacle between the receptacle clamping member and the receptacle lip clamping bar.

One or more lower hooks are mounted to a lower portion of the frame while one or more upper hooks are mounted to the receptacle clamping member for movement therewith. The upper and lower hooks are used to engage the upper and lower lifting bars on trash containers. The hooks are either removable from the clamping and lifting assembly or are retractable, such as by being pivotally mounted to the clamping and lifting assembly. This permits the hooks to be positioned in their operational positions, that is extending away from the truck, when the container is to be engaged and be displaced to their non-operational positions, that is either removed or pivoted out of the way, when receptacles or bins are being dumped.

After either a trash receptacle or a trash container is secured to the clamping and lifting assembly, the appropriate hydraulic lift cylinder is actuated to rotate the crank arm and the lift shaft thus tilting the trash can upwardly to deposit the contents into the trash sink of the truck. A pair of cradles and cradle gates are mounted to lateral extensions of the top member of the clamping and lifting assemblies adjacent the sides of the truck. The cradles and cradle gates define generally vertical slots within which the laterally extending studs of a trash bin are captured once the studs are placed adjacent the cradles and the cradle gates are pivoted against the cradles to secure the studs within the slots. To lift the trash bin, both clamping and lifting assemblies are actuated in unison in a dual operatinal mode.

A primary advantage of the present invention is its usefulness for dumping a wide range of automatically dumpable trash cans, that is trash bins having laterally extending studs, trash containers having upper and lower horizontal lifting bars and trash receptacles having outwardly and downwardly extending lip. Further, unlike prior art dumping apparatus, the low profile aspect of the clamping and lifting assembly permits the worker to get right next to the trash sink, which is necessary when manually dumping trash cans. Thus, a garbage truck incorporating the low profile trash can dumping apparatus can be used to service a number of different customers having one of at least three different types of automatically dumped trash cans as well as manually dumped trash cans. This aids scheduling and routing by the disposal company as well as eliminating the need for the worker to manually dump trash containers or trash receptacles.

One feature of the invention which helps to provides this flexibility is the ability to reposition the upper and lower hooks from their extended, operational configuration to their displaced, non-operational configuration. This may be accomplished in several ways. In the preferred embodiment, the upper hook is slidably mounted to the movable receptacle clamping member and temporarily secured to it by a pin lock. The lower hook, in the preferred embodiment, is hinged and spring loaded to be biased from its retracted, upwardly pivoted, non-operational configuration to its extended, operational configuration. The transformation between use with trash containers and either trash containers or trash bins is easily and quickly accomplished since all that the user needs to do is remove or replace the upper hooks. The lower hooks automatically pivot out of the way when engaged by a side of a trash bin or trash receptacle since their pivot hinges are positioned below their outer ends.

Another feature of the invention is that the same hydraulic clamping cylinder, or other driving device, is used to move the receptacle clamping member and the upper hook. Therefore both trash containers and trash receptacles are secured to the clamping and lifting assembly using the same type of motion. This greatly simplifies the operational circuit since the same sequence of steps occur regardless which of the two types of trash cans are used. Although the hydraulic clamping cylinders need not be operational when dumping trash bins, they may be since such operation should not interfere with the bin dumping sequence. This further simplifies the circuit. Also, the same tilting sequence can be used for all three trash cans.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 1:
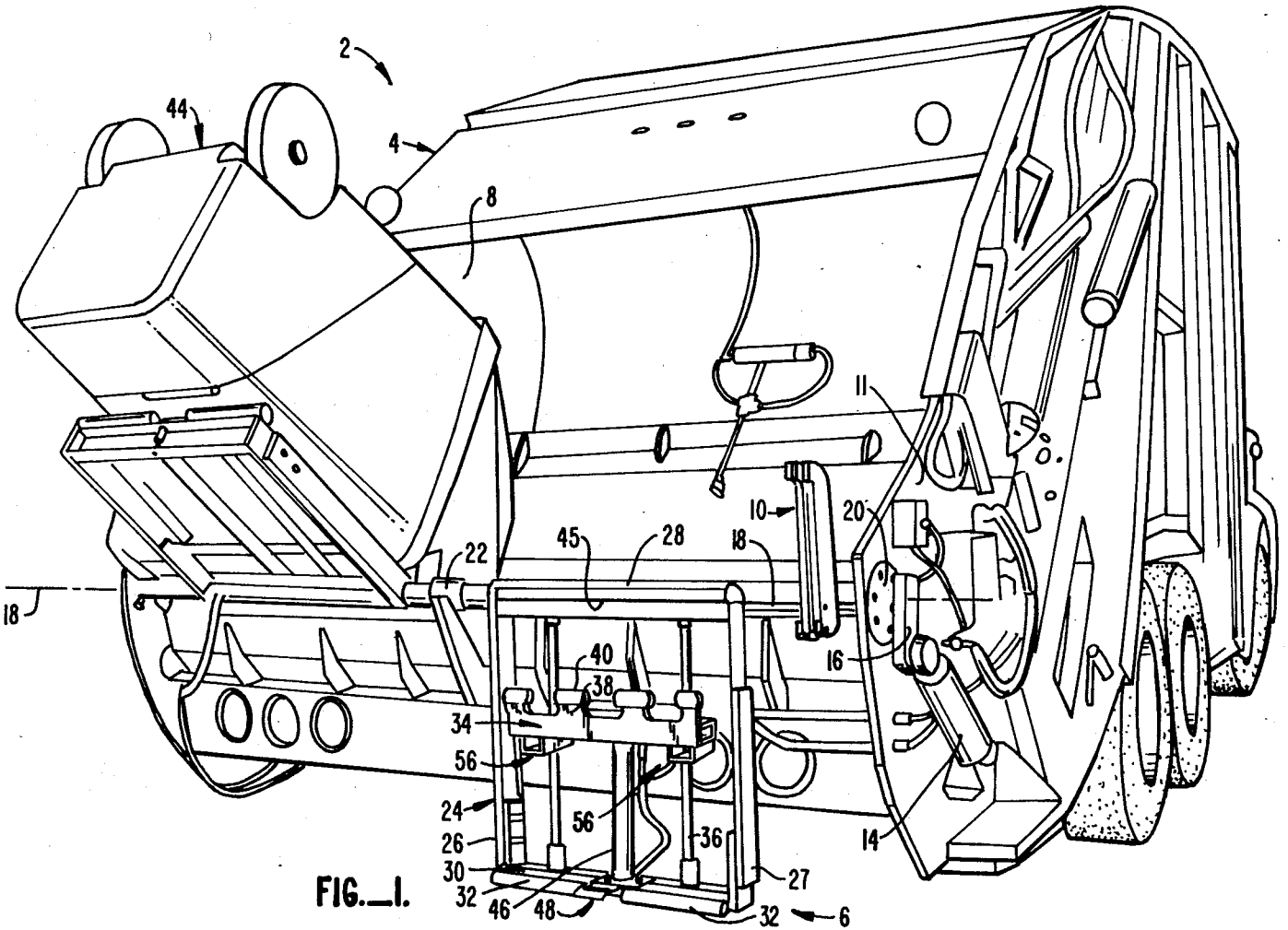
FIG. 1 is a perspective view of the low profile trash can dumping apparatus of the invention shown used with a garbage truck.

Turning now to FIG. 1, a low profile trash can dumping apparatus 2 is shown mounted to and used in conjunction with a garbage truck 4. Apparatus 2 includes clamping and lifting assemblies 6 mounted sideby-side to truck 4 adjacent a trash sink 8 in the truck. Apparatus 2 also includes a pair of cradle assemblies 10, mounted to a frame 24 of assemblies 6 on either side of the entrance to trash sink 8 and adjacent side walls 11, and a hydraulic power circuit 12.

Figure 4A:
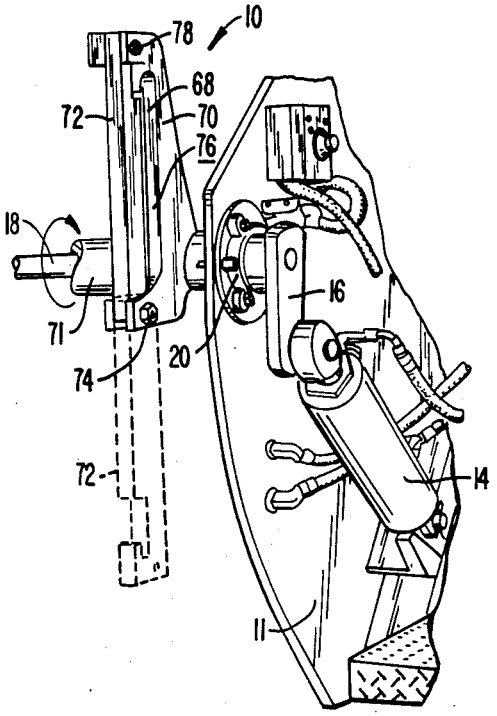
FIGS. 4A and 4B show the hydraulic lift cylinder and crank arm in the retracted or loading position and in the extended or dumping position.
Figure 3:
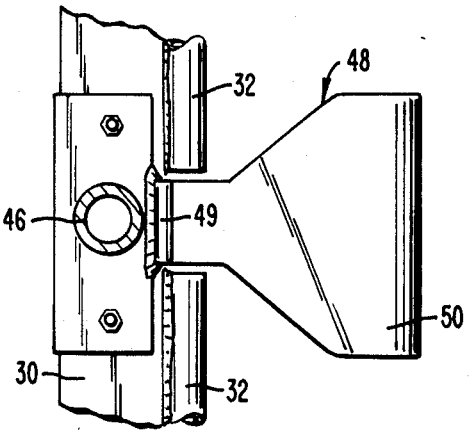
FIG. 3 is a top view of the lower hook taken along lines 3—3 of FIG. 2C.
Figure 4B:
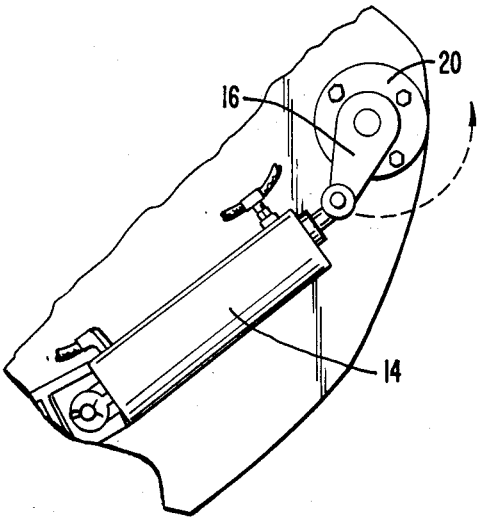

Circuit 12, shown schematically at FIG. 6 and described in more detail below, includes two hydraulic lift cylinders 14, each of which drives a crank arm 16. Crank arms 16 are each keyed or otherwise secured to a lift shaft 18. The lift shafts are supported by bearings 20 mounted to side walls 11 at one end and by a center support 22 at the other. See FIGS. 4A and 4B.

Referring now also to FIGS. 2A, 2B, 2C and 3, clamping and lifting assemblies 6 will be described in more detail. Note that portions of a trash receptacle 44 and a trash container 54 are both shown in phantom in FIGS. 2A–2C to illustrate how each is engaged by various elements of assembly 6. Each assembly 6 includes a generally rectangular frame 24 having a pair of sides 26, 27, a tubular top member 28 secured to lift shaft 18, and a bottom member 30 to which a paired contact bars 32, used to support trash bins 64 and trash receptacles 44 during use, are welded. The length of sides 26, 27 is adjustable according to the operating conditions. A receptacle clamping member 34 is mounted to a pair of tubular guides 36 for movement along a path 37 between top and bottom members 28, 30. Member 34 includes a number of upwardly extending fingers 38 having enlarged ends 40 sized to securely engage an outwardly and downwardly extending lip 42 of a trash receptacle 44. Note that lip 42 is captured between ends 40 and a horizontal surface 43 and a vertical surface 47 of a lip clamping bar 45 mounted to a top member 28. Movement of clamping member 34 is through a hydraulic clamping cylinder 46 mounted between clamping member 34 and bottom member 30.

Figure 2A:
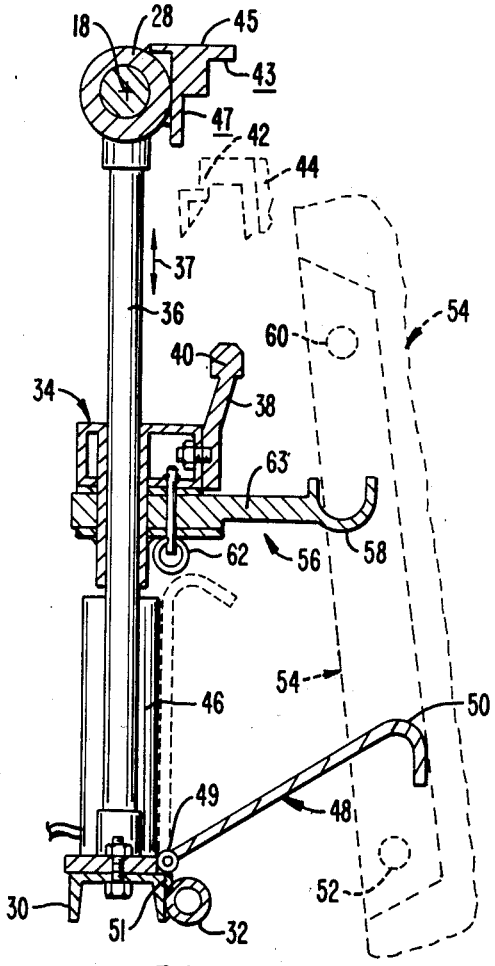
FIGS. 2A, 2B and 2C illustrate the clamping and lifting assembly at initial, intermediate and clamped positions respectively.

A lower hook 48 is pivotally mounted to bottom member 30 by a spring-biased hinge 49 to pivot between an outwardly extending, operational position, shown in solid lines in FIGS. 1 and 2A, and a retracted, non-operational position, shown in dashed lines in FIG. 2A. Lower hook 48 is moved to its non-operational position when contacted by a receptacle 44 or a bin 64. Hinge 49 biases lower hook 48 toward its operational position. A stop 51 extends from hook 48 adjacent hinge 49 and contacts bottom member 30 when in the operational position to prevent hook 48 from pivoting past its operational position. To accommodate stop 51, contact bars 32 are positioned on either side of lower hook 48. Lower hook 48 has an outer end 50 configured to engage the lower lifting bar 52 on a conventional horizontal bar-type trash container 54.

Figure 2B:
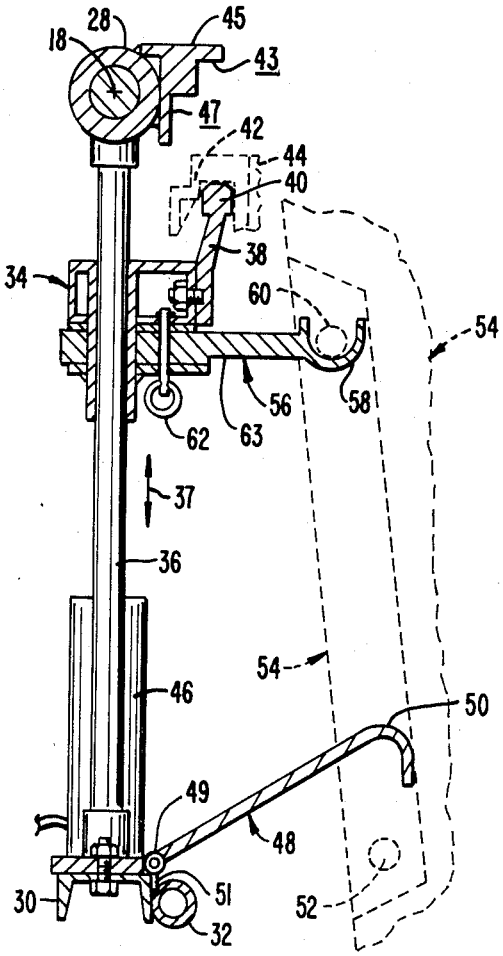
Figure 2C:
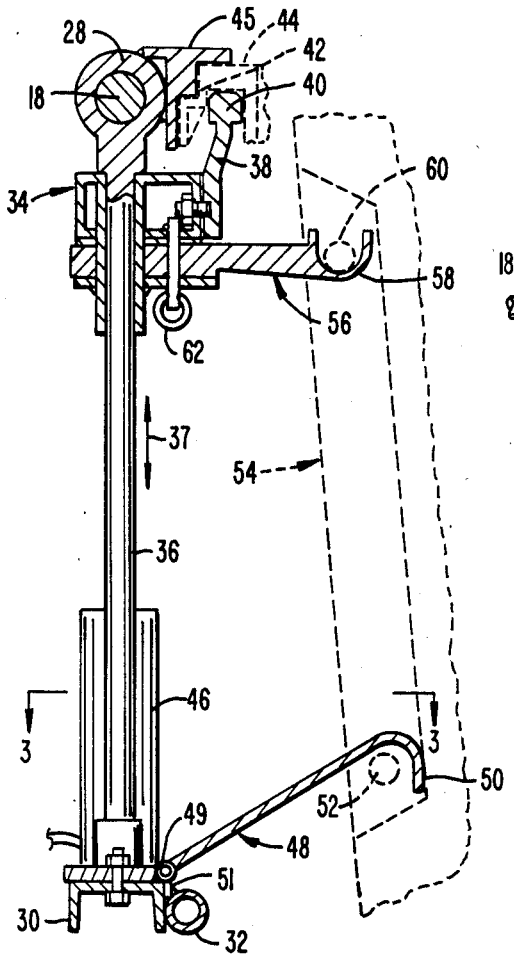

An upper hook 56 is removably secured to receptacle clamping member 34 and has an outer end 58 shaped to engage the upper lifting bar 60 of container 54. Assuming receptacle clamping member 34 and upper hooks 56 therewith are in the initial, lowered position of FIG. 2A, hooks 48, 56 are positioned between lower and upper lifting bars 52, 60. Upon actuation of cylinder 46, upper hook 56 rises until it engages upper bar 60 as shown in FIG. 2B. Further upward movement of upper bar 56 lifts container 54 until upper hook 56 reaches the top of its travel as shown in FIG. 2C. At this time, lower bar 52 is secured within outer end 50 of lower hook 48. At this point, clamping and lifting assembly 6 is rotated by actuating lift cylinder 14 thus allowing the trash within container 54 to be dumped into trash sink 8.

Many types of conventional trash receptacles 44 and trash bins 64 are constructed so that lower and upper hooks 48, 56 would interfere with the proper securement of receptacle 44 or a bin 64 (see FIG. 5) to assembly 6 if hooks 48, 56 were left in place. Therefore, removable locking pin 62 is used to secure a stem 63 of hook 56 to member 34 so upper hooks 56 can be removed when needed. Although lower hooks 48 could be similarly mounted, they are, in the preferred embodiment, secured to member 30 by hinge 49 so that when not needed, lower hooks 48 can be pivoted out of the way. Note that upper hooks 56 are not shown in FIG. 1; they have been removed because trash receptacles 44, rather than trash containers 54, are being dumped.

Figure 5:
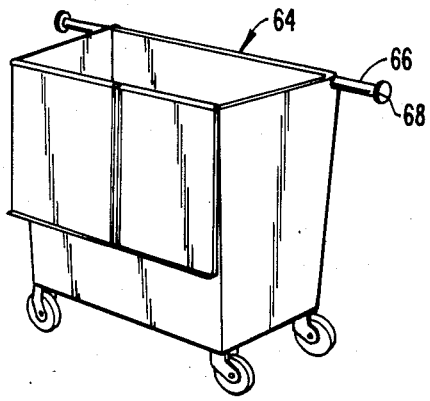
FIG. 5 shows a trash bin.

Turning now to FIG. 5, trash bin 64 is shown. Trash bin 64 is about as long as trash sink 8 is wide and has a pair of outwardly extending studs 66 with enlarged disc ends 68. Studs 66 fit within the slots 68 formed by cradle assembly 10. Each cradle assembly 10, see FIGS. 1 and 4A, includes a cradle 70, rigidly mounted to an outer extension 71 of top member 28, and a cradle gate 72 which is pivotally mounted to cradle 70 for movement about a pivot 74. To mount studs 66 within slots 68, each gate 72 is pivoted to the dashed line position of FIG. 4A and trash bin 64 is moved adjacent assemblies 6 until studs 66 are near or touching contact surfaces 76 of cradles 70. Gates 72 are then pivoted upwardly capturing studs within slots 68 formed between cradles 70 and cradle gates 72. Gates 72 are secured in place by a lock pin 78. Trash bin 64 is then dumped by actuating both clamping and lifting assemblies 6 at the same time.

Figure 6:
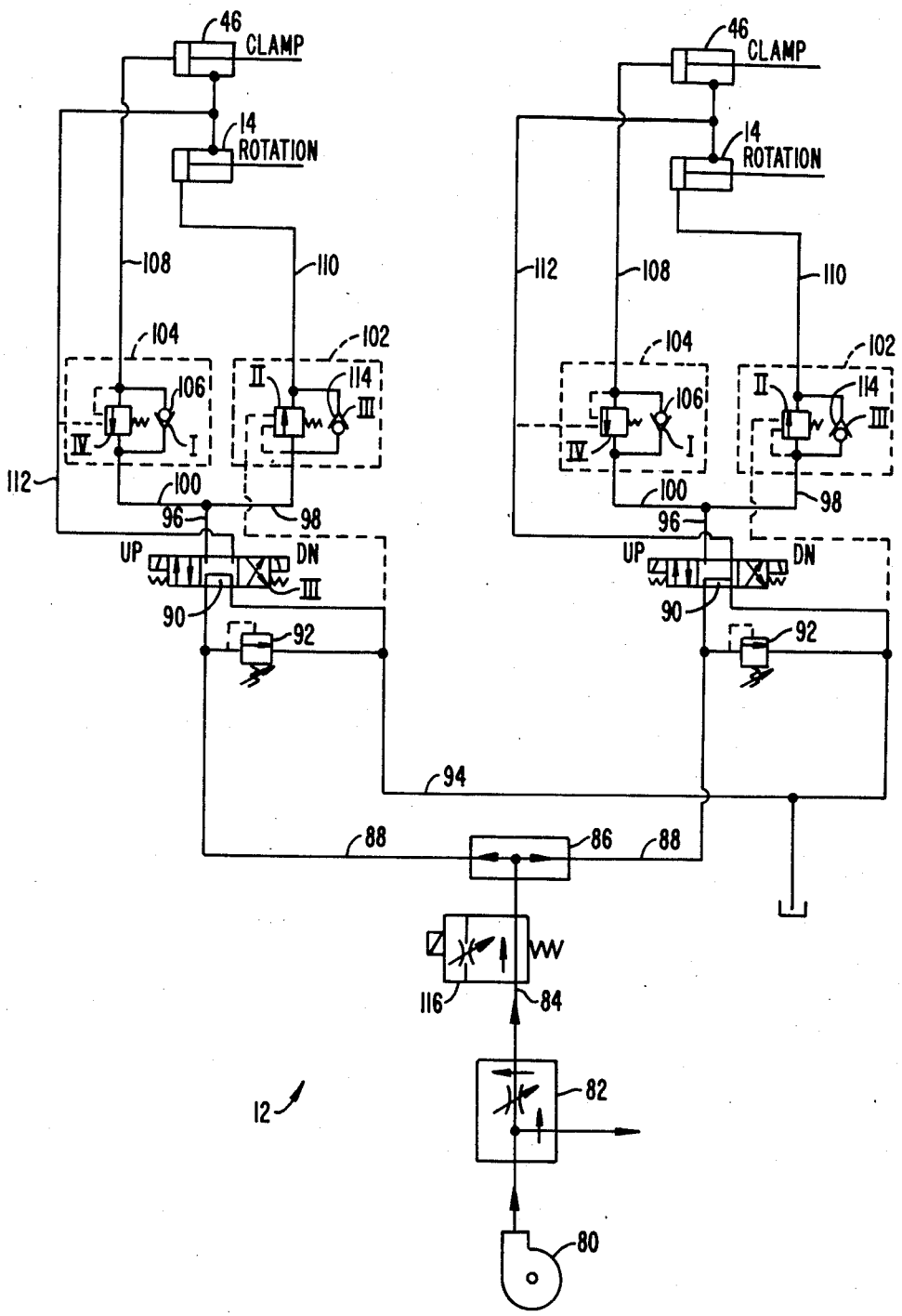
FIG. 6 is a schematic representation of the hydraulic circuit powering the lift and clamp cylinders.

Referring to FIG. 6, circuit 12 includes a pump 80 which pumps hydraulic fluid through a priority valve 82 which ensures a sufficient flow is directed along a priority line 84. The remaining hydraulic fluid passes to the packer system, not shown, of truck 4. Looking at either the left-hand or the right-hand segment of circuit 12, after passing through a 50-50 flow divider 86 hydraulic fluid flows along a line 88 to a three-way control valve 90. A pressure release valve 92 connects line 88 to a return line 94. Three-way control valve 90 is shown in a neutral or idle condition.

Valve 90 is moved to the right, that is to the parallel arrow configuration, during clamping and rotation up. When moved to the right, fluid is directed along a line 96 and then along lines 98 and 100 to a sequence valve 102 and to a counterbalance valve 104. Hydraulic fluid first flows through a check valve portion 106 of counterbalance valve 104, tis being indicated by the Roman numeral I on the drawing. Thus, fluid first flows along lines 88, 96, 100 through check valve portion 106 and then through a line 108 into clamping cylinder 46. This causes member 34 to move upwardly clamping the appropriate trash can, either receptacle 44 or container 54, into position. Next the pressure in line 98 begins to build. This is sensed by sequence valve 102 which then opens allowing hydraulic fluid to flow through a line 110 to the rotation cylinder. This sequence of operations is indicated by Roman numeral II.

At the end of the rotation up step, assembly 6, assuming it it in the automatic cycling mode, hits a microswitch, not shown, which moves the solenoid actuated three-way control valve 90 from the load position (parallel arrows) to the neutral position, after a time delay relay has timed out, valve 90 moves to the unload position (crossed arrows), step III. Fluid is then directed from line 88 into a line 112 attempting to reverse the operation of assembly 6. The fluid in rotation cylinder 14 first flows back along line 110 through the check valve portion 114 of sequence valve 102, through lines 98 and 96, through valve 90 and finally through return line 94. This is indicated by Roman numeral IV.

Next, counterbalance valve 109, sensing the differential in pressure between lines 108 and 112, allows hydraulic fluid to flow through the counterbalance valve from clamp cylinder 45 after the rotation has ceased, step V. Once the clamping mechanism has been fully retracted, the operator moves a three-way switch 126 (see FIG. 7) to a center or neutral position to return control valve 90 back to its central or neutral position.

If it is desired to operate both clamping and rotation mechanisms at the same time, such as when dumping bins 64, solenoid actuated valves 90 are operated together, such as using the circuit described below with reference to FIG. 7. Sometimes, such as when dumping bins 64, it is desired to slow down the operation of apparatus 2. To do so a selective restrictor valve 116 can be placed along line 84. During normal operations flow through valve 116 is unrestricted. When slower speed operation is desired valve 116 is actuated to restrict the flow of fluid to, for example, one-half of the unrestricted flow.

Figure 7:
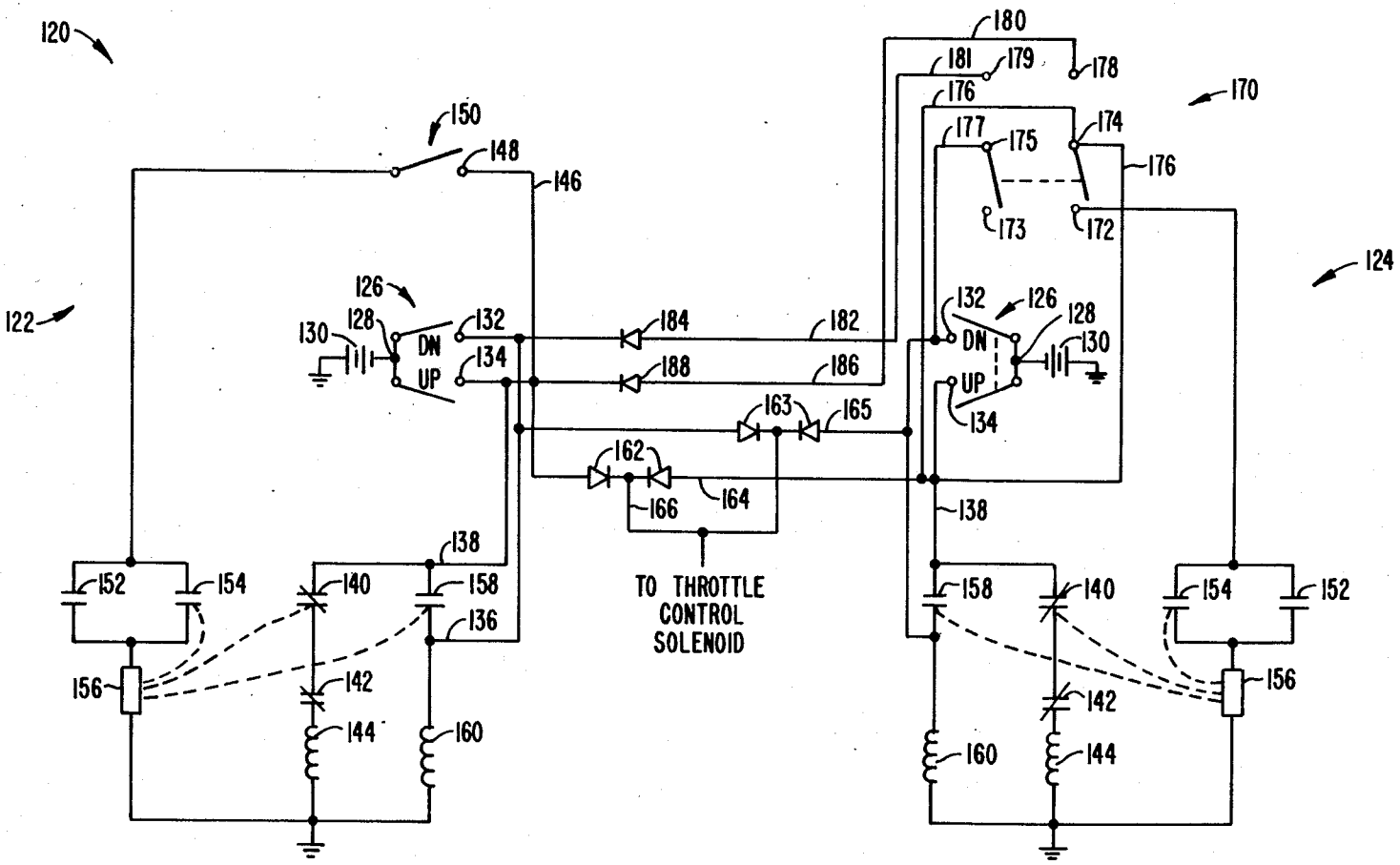
FIG. 7 is a schematic representation of the electrical control circuit.

Referring now to FIG. 7, a control circuit 120, used in conjunction with hydraulic circuit 12, is disclosed. Control circuit 120 includes a first or driver side portion 122 and a second or passenger side portion 124. Portions 122 and 124 are quite similar so that first portion 122 will be described first and similar elements in the second portion are provided with the same identifying numbers. Portion 122 includes a three-way user operated switch 126, shown in the neutral position in FIG. 7. Switch 126 has a common terminal 128 connected to a voltage source 130 and terminals 132, 134 connected to lines 136, 138, respectively. When it is desired to clamp and lift a trash can, switch 126 is actuated so that terminal 134 is connected to common terminal 128. This provides current to a normally closed time delay relay switch 140, normally closed limit switch 142 and an up-limit solenoid coil 144, all positioned in series along line 138. This causes three-way valve 90 on the driver's side of the truck, which we can assume is the left-hand side of the circuit shown in FIG. 6, to move to the right to the parallel arrow configuration. This results in the operation of the hydraulic circuit as discussed above with reference to FIG. 6. Connecting terminals 128 and 1334 also supplies current to a terminal 148 of a cycle switch 150 along a line 146. Assuming cycle switch 150 is closed, current is also supplied to a first, normally open up-limit swithc 152 and a second normally open time delay relay switch 154, switches 152 and 154 connected in parallel. At the end of the up rotation step assembly 6 closes limit switch 152, so that current is applied to a time delay relay 156, connected between switches 152, 154 and ground, and opens limit switch 142, to remove current from coil 144. After a sufficient period of time, which allows the contents of the trash can to be completely emptied, time delay relay 156 times out thus closing switch 154, opening switch 140 and closing a normally open time delay relay switch 156. Switch 158 is connected in parallel to switch 140 and in series with a down solenoid valve coil 160. This cuts off current to coil 144 and supplies current to coil 160 which causes assembly 6 to begin to rotate downwardly. As it does so limit switch 142 is closed and limit switch 152 is opened. The user then manually returns switch 126 to the neutral position of FIG. 7 to remove current from time delay relay 156 to cause switches 154 and 158 to open and 140 to close.

If one wishes to manually cycle assembly 6 up and down, switch 150 is opened so that current is never applied to time delay relay 156 and thus switch 140 remains closed and switch 158 remains open. Therefore, after assembly 6 has been raised, limit switch 142 opens so that three-way valve 90 returns to its neutral position. To return assembly 6 back to its initial, lowered or loading position, switch 126 is actuated to connect terminals 128 and 132 to provide current along line 136 and thus to down solenoid valve 160. This causes three-way valve 90 to shift to the left to the crossed arrow position driving the assembly back down to the initial or lowered position. After being lowered, switch 126 is returned to the neutral position shown in FIG. 7.

For some trucks the normal idle is not sufficiently fast to power pump 80. In these cases a pairs of diodes 162, 163 are placed along lines 164, 165 connected to terminals 134, 132, respectively. Diodes 162, 163 are used to prevent feedback between circuit portions 122, 124. A line 166 is connected between diodes 162 and 163 so as to supply current to a throttle control solenoid, not shown, whenever terminal 128 and either terminals 132 or 134 are connected.

Second, passenger portion 124 of control circuit 120 is substantially the same as first portion 122 except it includes a double pole, double throw switch 170 to allow both of the clamping and lifting assembly 6 to be operated at the same time from the passenger side of truck 4. Switch 170 includes a pair of cycle terminals 172, 173. Terminal 172 is connected to limit switch 152 and time delay relay switch 154 while terminal 173 is not connected to anything. Switch 170 also includes common terminals 134, 132 of portion 124 by lines 176, 177. Switch 170 has a pair of dual operation terminals 178, 179 connected to up and down terminals 134, 132 of second portion 124 through lines 180, 181.

Down terminal 132 of portion 124 is connected to down terminal 132 of portion 122 by a line 182 through a diode 184. Similarly, up terminals 134 are connected through a line 186 and a diode 188. Connecting terminal 175 to terminal 173 and terminal 174 to terminal 172 by using switch 170 functions in a similar manner to the closing of switch 150 of portion 122. Moving switch 170 to its neutral position, illustrated in FIG. 7, places circuit portion 124 in the manual or noncycling mode; this is equivalent to opening switch 150 in portion 122. However, connecting terminals 174, 175 with terminals 178, 179 places control circuit 120 in a dual, manual mode. This allows the user to control both clamping and lifting assemblies 6 by the operation of three-way switch 126 on the passenger side of the vehicle. When in this dual mode, terminals 132 and 134 of portion 124 are connected to the corresponding terminals of portion 122 through line 177 and 176, lines 181 and 180, lines 182 and 186 and diodes 184, 188, respectively. Thus, when in the dual, manual mode, applying power to terminals 132 or 134 on the passenger side also applies power to terminals 132 and 134 on the driver's side to either raise or lower both assemblies 6.

In use the worker either positions upper and lower hooks 48, 56 in their extended, operating positions or removes them from the operating positions according to whether or not horizontal bar trash containers 54 are to be unloaded. If they are, trash container 54 is wheeled up against assembly 6 so that upper and lower hooks 56, 48 are positioned between upper and lower bars 60, 52. The appropriate switch 90 is actuated so hooks 56, 48 engage bars 60, 52 to lift and dump container 54.

If trash receptacles 44 are to be unloaded, upper hooks 56 are removed as appropriate. Then each receptacle 44 is wheeled against an assembly 6 with its lip 42 adjacent lip clamping bar 45. Doing so causes lower hook 48 to pivot up and out of the way. Upon actuation of the appropriate valve 90, member 34 raises and captures lip 42 between the enlarged ends 40 of fingers 38 and bar 44. Rotation cylinder 14 then rotates assembly 6 to lift and dump the contents of receptacle 44 into trash sink 8.

If trash bins 64 are to be dumped, cradle gates 72 are swung downwardly and trash bin 64 is wheeled up against both clamping and lifting assemblies 6 so that upon raising gates 72, studs 66 are captured between gates 72 and cradles 70. Doing so causes lower hook 48 to pivot up and out of the way. Both three-way control valves 90 are then actuated in unison which first raises members 34. After clamping members 34 are in the fully up position of FIG. 2C, lift cylinders 14 drives crank arms 16 to lift trash bin 64. After the trash is dumped, assemblies 6 pivot back to their generally vertical, load position after which members 34 are lowered. Both cradle gates 72 are pivoted away from cradles 70 to release trash bin 64.

Modification and variation can be made to the disclosed embodiment without departing from the subject of the invention as defined in the following claims. For example, apparatus 2 has been shown with a pair of clamping and lifting assemblies 6. If desired, and according to the size of the various cans to be dumped, a greater or lesser number may be used. For example, a single, centrally placed clamping and lifting assembly 6 may be used in some circumstances. The invention has been shown when used in conjunction with the garbage truck as a refuse sink. It may also be used in conjunction with other refuse sinks, which may be transportable or stationary.

I claim:

1. Low profile trash container dumping apparatus for semi-automatically dumping refuse from trash bins, trash containers and trash receptacles into a refuse sink while permitting close physical access to the trash sink for the manual dumping of trash cans into the trash sink, the trash bins having laterally extending studs, the trash containers having upper and lower lifting engagement members and the trash receptacles having a mechanically engageable lip, the dumping apparatus comprising:

a support structure adjacent the refuse sink;

clamping and lifting apparatus mounted to the support structure, comprising:

a frame, having first and second ends, pivotally mounted at the first end to the support structure for movement about a common axis;

a trash receptacle lip engaging assembly mounted to the frame and including a clamping member movable along a path between a lip release position and a lip engaging position; and a trash container engagement member engaging assembly including lower hook means, mounted to the frame, for engaging the lower engagement member and upper hook means, mounted to the clamping member for movement therewith, for engaging the upper engagement member, the lower and upper hook means displaceable between extended, operational positions, for use when dumping trash containers, and displaced, non-operational positions, so not to interfere when dumping trash bins and trash receptacles;

means for driving the clamping member and the upper hook means therewith along the path;

means for rotating the frame about the common axis between a loading position and a dumping position; and first and second spaced apart cradle assemblies, coupled to the frame for rotation therewith, for engaging the trash bin studs when the trash bin is adjacent the clamping and lifting apparatus.

2. The dumping apparatus of claim 1 wherein the frame includes a clamping bar secured at the first end, the clamping bar and clamping member positioned and configured to capture the engageable lip of the trash receptacle therebetween when the clamping member is adjacent the clamping bar.

* * * * *